US005380165A

United States Patent [19]

Kimura et al.

[11] Patent Number: 5,380,165

[45] Date of Patent: Jan. 10, 1995

[54] RECIPROCATING-PISTON TYPE REFRIGERANT COMPRESSOR WITH AN IMPROVED ROTARY-TYPE SUCTION-VALVE MECHANISM

[75] Inventors: Kazuya Kimura; Shigeyuki Hidaka; Chuichi Kawamura; Hiroaki Kayukawa; Masafumi Ito; Yoshihiro Fujisawa, all of Kariya, Japan

[73] Assignee: Kabushiki Kaisha Toyoda Jidoshokki Seisakusho, Aichi, Japan

[21] Appl. No.: 131,453

[22] Filed: Oct. 4, 1993

[30] Foreign Application Priority Data

Oct. 2, 1992 [JP] Japan ..... 4-264977

[51] Int. Cl.[6] ..... F04B 1/12

[52] U.S. Cl. ..... 417/269; 91/480; 91/499; 137/312; 137/625.11

[58] Field of Search ..... 417/269, 516, 532, 539, 417/222.1, 222.2; 91/480, 484, 499; 137/312, 625, 625.47

[56] References Cited

U.S. PATENT DOCUMENTS 5,232,349 8/1993 Kimura et al. ..... 417/222.1

FOREIGN PATENT DOCUMENTS 59-145378 8/1984 Japan .

571467 3/1993 Japan .

*Primary Examiner*—Richard A. Bertsch

*Assistant Examiner*—Alfred Basichas

*Attorney, Agent, or Firm*—Burgess, Ryan and Wayne

[57] ABSTRACT

A reciprocating-piston-type refrigerant compressor provided with a cylinder block having formed therein a plurality of cylinder bores in which a plurality of pistons are reciprocated to effect suction, compression and discharge of refrigerant gas in response to rotation of a drive shaft, a rotary valve element connected to the drive shaft to be rotated together with the drive shaft within a recessed chamber formed in the cylinder block, the valve element having a suction passageway for sequentially introducing the refrigerant gas before compression of the plurality of cylinder bores during the rotation of the rotary valve element, gas receiving grooves formed in the inner wall of the recessed chamber for receiving a part of the compressed refrigerant gas leaking from respective cylinder bores in the phase of the compressing and discharging operations into a contacting area between the inner wall of the recessed chamber and the rotary valve element, and a gas routing passageway formed in the rotary valve element so as to route the compressed refrigerant gas received by the gas receiving grooves into respective cylinder bores in the phase of the initial stage of the compressing operation.

9 Claims, 6 Drawing Sheets

RECIPROCATING-PISTON TYPE REFRIGERANT COMPRESSOR WITH AN IMPROVED ROTARY-TYPE SUCTION-VALVE MECHANISM

BACKGROUND OF THE INVENTION

1. Field of the Invention

The present invention relates to a reciprocating-piston type refrigerant compressor adapted for use in compression of a refrigerant gas for an air-conditioning system of an automobile, which is provided with a refrigerant-gas-suction mechanism including a rotary-type suction valve fixed to a rotatable drive shaft which an external drive force is applied by the engine of the automobile so as to operate the compressor. More particularly, it relates to a rotary-type suction valve mechanism accommodated in the above-described reciprocating-piston type refrigerant compressor and has an improved internal construction enabling it to maintain adequate volumetric compression efficiency and also adequate drive force-to-work efficiency while suppressing a rise in the temperature of the discharged refrigerant gas.

2. Description of the Related Art

A typical reciprocating-piton-type compressor is disclosed in, for example, Japanese Unexamined Patent Publication (Kokai) No. 59-145378, in which a swash-plate-type rotation-to-reciprocation conversion mechanism is mounted on a drive shaft to reciprocate the pistons in a plurality of axial cylinder bores formed in a cylinder block arranged to be in parallel with the rotating axis of the drive shaft. The reciprocation of the pistons in the cylinder bores of the cylinder block pumps refrigerant gas into the cylinder bores, compresses the pumped refrigerant gas within the cylinder bores, and discharges the compressed refrigerant gas from the cylinder bores. The above-described reciprocating-piston type compressor is provided with housings attached to both ends of the cylinder block via valve plates, and the housings define therein suction chambers for receiving therein the refrigerant gas before compression to be supplied into the cylinder bores and discharge chambers for receiving the refrigerant gas after compression discharged from the cylinder bores. The supply of the refrigerant gas from the suction chambers toward the cylinder bores is carried out through suction ports bored in the valve plates when the suction ports are opened by suction valves attached to the inner face of each valve plate. The suction valve in the shape of a flapper type valve is arranged so as to be moved from a suction-port closing position toward a suction-port opening position in response to a reduction of gas pressure in the related cylinder bore during the movement of the associated reciprocating piston from the top dead center thereof toward the bottom dead center thereof in the cylinder bore. The discharge of the compressed refrigerant gas from each of the respective cylinder bores toward the discharge chambers of the housings is carried out through discharge ports bored in the valve plates when the discharge ports are opened by flapper-type discharge valves attached to the outer face of each of the valve plates. Each discharge valve is moved from a discharge-port closing position to a discharge-port opening position when the related piston is moved from the bottom dead center thereof toward the top dead center thereof within the corresponding cylinder bore.

In the above-described conventional reciprocating-piston type compressor, the flapper-type suction valves made of an elastic material are elastically urged toward the respective suction-port closing positions, and are moved toward the respective suction-port opening positions against the elastic force exerted by themselves. Namely, the suction valve is not able to be quickly moved from the suction-port closing position thereof to the suction-port opening position thereof during the suction phase of the related cylinder bore, and accordingly, a large amount of loss of suction pressure occurs, which lowers the volumetric compression efficiency.

To overcome the above-mentioned defect of the conventional reciprocating piston type compressor with the flapper-type suction valve mechanism, Japanese Unexamined Patent Application (Kokai) No. 5-71467 (JP-A-5-71467) filed by Toyoda Jidoshokki Kabushikikaisha corresponding to the Assignee company of the present U.S. Patent Application has proposed a reciprocating-piston type compressor provided with a suction valve mechanism improved so as to appreciably increase the volumetric compression efficiency of the compressor.

In the proposed reciprocating-piston type compressor of JP-A-5-71467, a rotary type suction valve element connected to a drive shaft to be rotated together with the drive shaft is used for successively supplying respective cylinder bores of the compressor with suction refrigerant gas during the rotation thereof in a cylindrical chamber centrally recessed in the cylinder block of the compressor. The rotary-type suction valve element has a suction passageway formed therein to provide a fluid communication between a suction chamber of the compressor and the respective cylinder bores in the suction phase, via communication passageways radially extending between the cylindrical chamber and the respective cylinder bores of the cylinder block. The use of the rotary-type suction valve element is effective for smoothly and constantly supplying the refrigerant gas from the suction chamber into respective cylinder bores.

Further, the rotary-type suction valve element of the compressor of JP-A-5-71467 is also provided with a bypass passageway for routing a residual refrigerant gas, i.e., a part of the compressed refrigerant gas remaining in respective cylinder bores without being discharged therefrom at the final stage of the discharging phase, toward respective cylinder bores which are at the initial stage of the compression phase. Accordingly, a loss of suction pressure in each of the respective cylinder bores of the compressor of JP-A-5-71467 can be appreciably reduced. Thus, the reciprocating-piston type compressor is able to exhibit an adequate volumetric compression efficiency.

Nevertheless, the compressor of JP-A-5-71467 must still suffer from defects as described below.

When the compressor is driven by a drive force given to the drive shaft, the rotary-type suction valve element rotates in the cylindrical chamber of the cylinder block so as to distribute the refrigerant gas into respective cylinder bores in the suction phase. The rotary-type suction valve element is constantly in sliding contact with the inner wall of the cylindrical chamber, and accordingly, the inner wall of the cylindrical chamber functions as an air-tight valve seat capable of preventing the refrigerant gas under high pressure from leaking from respective cylinder bores. It is, however, impossible to completely prevent a part of the refrigerant gas under high pressure from leaking out of respective cylinder bores in the compressing and/or discharging phases into the contacting area between the cylindrical chamber and the rotary-type suction valve element by way of the afore-mentioned radial communication passageways of the cylinder block. At this stage, since the compressor of JP-A-5-71467 is not provided with any means for appropriately returning the leaking refrigerant gas toward respective cylinder bores in the compressing and/or discharging phase, the refrigerant gas leaking from the contacting area between the cylindrical chamber and the rotary-type suction valve element gradually enters a lower pressure region within the compressor body such as the suction chamber communicating with the cylindrical chamber of the cylinder block, the wobble plate chamber or crank chamber communicating with one end of the rotary-type suction valve element, and the suction passageway of the valve element per se. Consequently, the lowering of the volumetric compression efficiency of the compressor cannot be avoided. The lowering of the volumetric compression efficiency brings about a reduction in the amount of the compressed refrigerant gas circulating through the air-conditioning system. Further, in spite of the above-mentioned lowering of the volumetric compression efficiency and the reduction in the circulating amount of the compressed refrigerant gas, the drive force necessary for operating the compressor is not reduced, and thus a ratio between the drive force presented to the compressor by an external drive source such as an automobile engine and a work done by the compressor, i.e., the drive force-to-work efficiency is low, and the temperature of the compressed refrigerant gas measured at the delivery port of the compressor is considerably high. This high temperature of the compressed refrigerant gas adversely affects the function of the condenser of the air-conditioning system, and accordingly, the performance of the air-conditioning system is degraded.

SUMMARY OF THE INVENTION

Therefore, an object of the present invention is to obviate the defects encountered by the reciprocating-piston type compressor with the conventional rotary-type suction valve mechanism.

Another object of the present invention is to provide a reciprocating-piston type compressor provided with a rotary-type suction valve mechanism improved so as to exhibit appreciably high volumetric compression efficiency and drive force-to-work efficiency, and being capable of preventing the rise in the temperature of the compressed refrigerant gas delivered from the compressor.

In accordance with the present invention, there is provided a reciprocating-piston type refrigerant compressor provided with a body including a cylinder block having a central bore extending axially about a central axis, a plurality of axial cylinder bores formed in the cylinder block of the body and arranged around the central axis of the cylinder block, a crank or swash plate chamber formed in the body as an independent chamber separate from the cylinder bores of the cylinder block, an axial drive shaft extending through the crank chamber and rotatably supported in the body, the axial drive shaft having one end disposed in the central bore of the cylinder block, at least one suction-gas-receipt chamber formed in the body for receiving refrigerant gas before compression, and a plurality of reciprocating pistons axially slidably received in the plurality of cylinder bores and reciprocated by a piston drive mechanism arranged in the crank chamber so as to be driven by the drive shaft.

The compressor is characterized by comprising:

a rotary valve unit connected to the one end of the drive shaft so as to rotate together with the drive shaft, the rotary valve unit having a generally cylindrical outer circumference thereof, and a suction passageway for permitting the refrigerant gas before compression to be pumped from the suction-gas-receipt chamber into the respective cylinder bores in a timed relationship with the reciprocation of the reciprocating pistons during rotation of the rotary valve unit;

a unit for defining a recessed chamber in the central bore of the cylinder block for rotatably receiving the rotary valve unit, the recessed chamber being surrounded by an inner wall area in sealing contact with the cylindrical outer circumference of the rotary valve means;

a first unit for receiving a part of the compressed refrigerant gas leaking from the respective cylinder bores in the phase of compressing and discharging operation into a contacting area between the inner wall area of the recessed chamber and the outer circumference of the rotary valve unit;

a second unit for routing the part of the compressed refrigerant gas received by the first unit into the respective cylinder bores in the phase of an initial stage of compressing operation immediately after the suction phase.

BRIEF DESCRIPTION OF THE DRAWINGS

The above and other objects, features and advantages of the present invention will be made apparent from the ensuing description of preferred embodiments thereof in conjunction with the accompanying drawings wherein.

DESCRIPTION OF THE PREFERRED EMBODIMENTS

Figure 1:
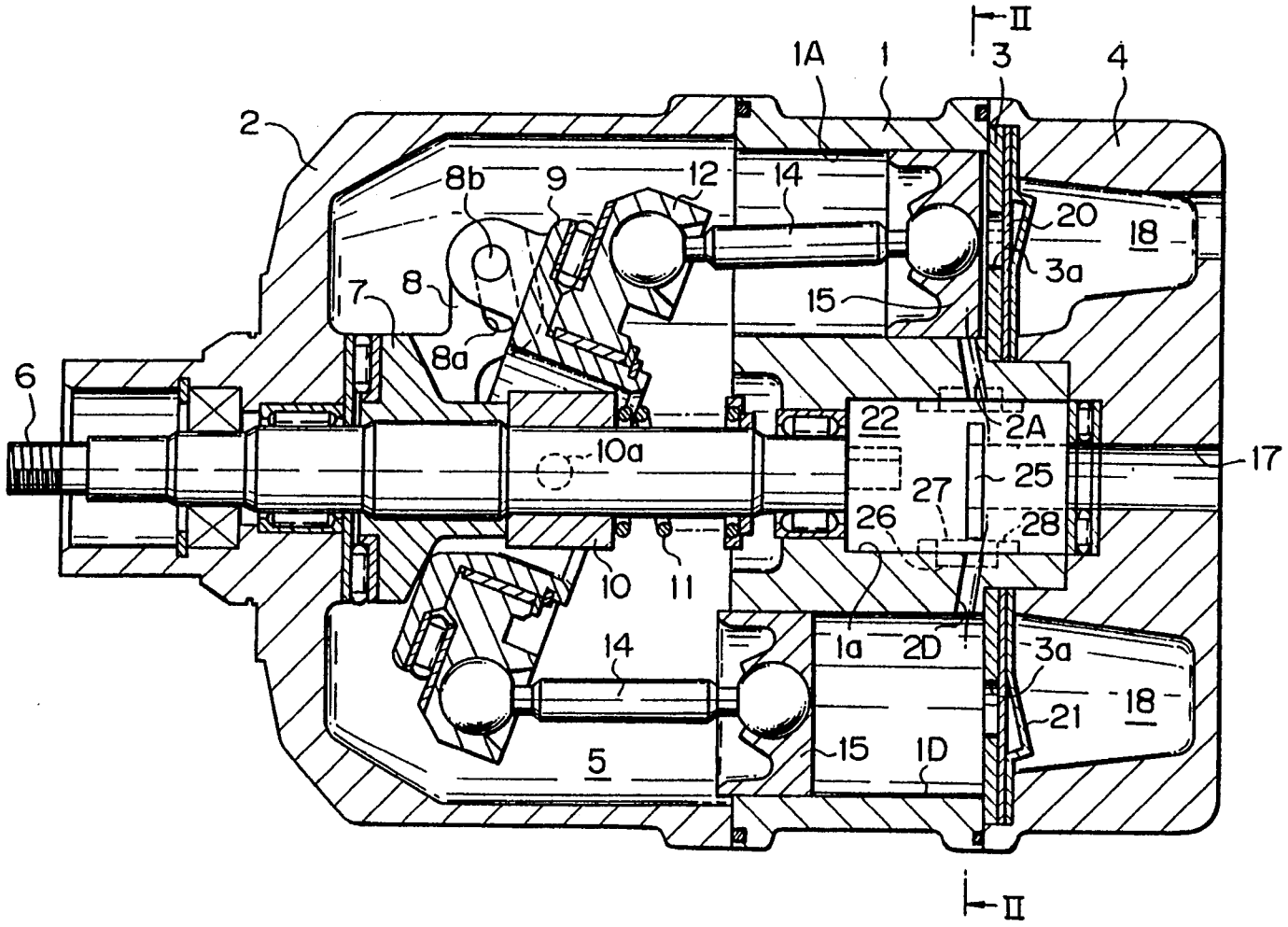
FIG. 1 is a longitudinal cross-sectional view of a reciprocating-piston type compressor with an improved rotary-type suction valve mechanism according to a first embodiment of the present invention.
Figure 2:
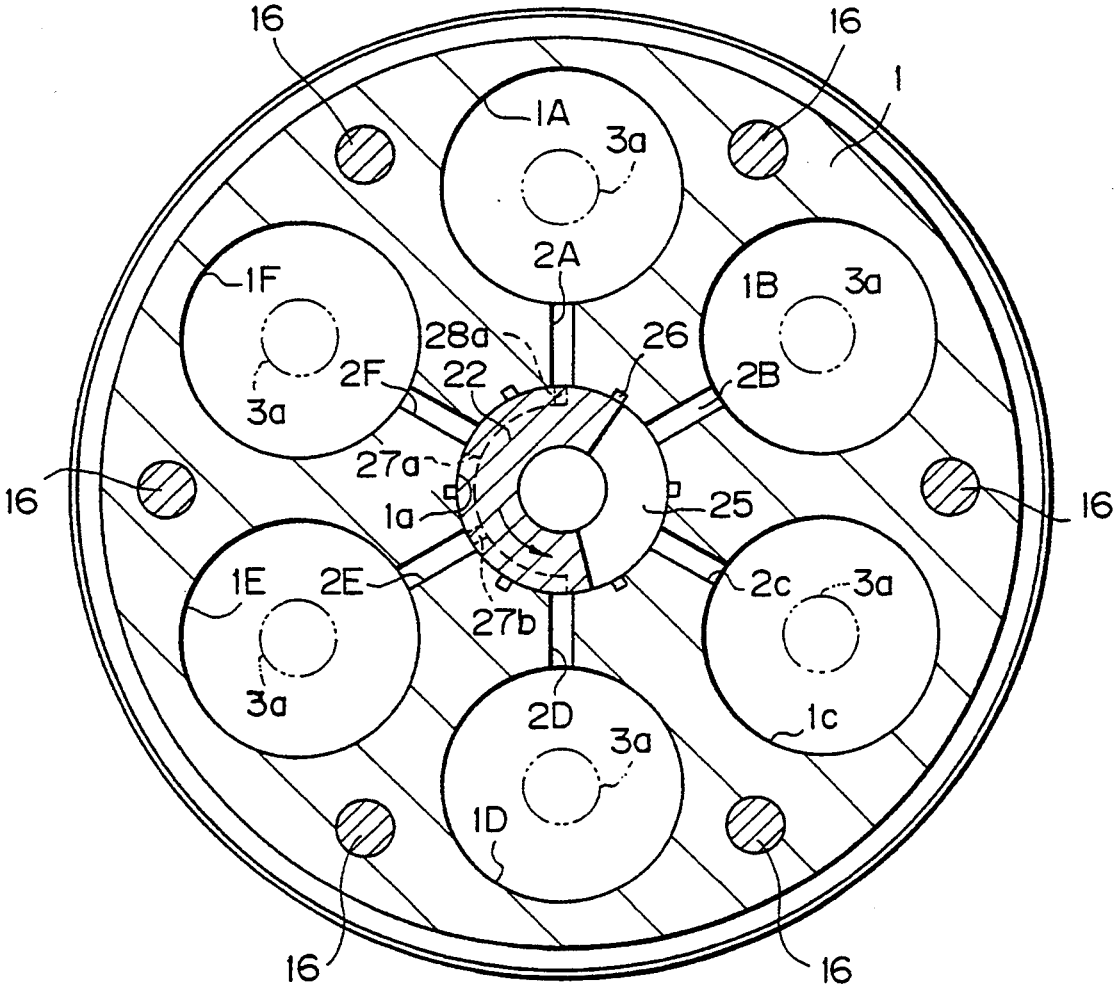
FIG. 2 is a cross-sectional view taken along the line II—II of FIG. 1.

Referring to FIGS. 1 and 2, the compressor of the first embodiment of the present invention is formed as a wobble-plate-operated reciprocating-piston type compressor provided with a compressor body including a cylinder block 1, a front housing 2, and a rear housing 4. The cylinder block 1 is provided with an axial bore 1*a* centrally formed therein for the purpose of receiving therein a later-described rotary-type valve element. The cylinder block 1 is also provided with a plurality of (six) cylinder bores 1A through 1F in the form of through-bores axially extending between front and rear ends thereof and equiangularly arranged around the axis of the axial bore 1*a*. The front housing 2 is air-tightly attached to the front end of the cylinder block 1 so as to define a crank chamber 5. The rear housing 3 is air-tightly attached to the rear end of the cylinder block 1 via a valve plate 3. A drive shaft 6 is disposed so as to extend axially through the crank chamber 5. A front part of the drive shaft 6 is rotatably supported by a bearing seated in the front housing 2, and a rear part of the drive shaft 6 is rotatably supported by a bearing seated in the central bore 1*a* of the cylinder block 1. The frontmost end of the drive shaft 6 extends outwardly beyond the front housing 2 so as to be connected to an external drive source, i.e., an automobile engine. The rotation of the drive shaft 6 is transmitted to a rotor 7 fixedly mounted on the drive shaft 6. The rotor 7 rotating together with the drive shaft 6 is provided with a rearwardly extending support arm 8 having an elongated hole 8*a* formed in an extreme end of the support arm 8. A connecting pin 8*b* is slidably fit in the elongated bore 8*a* of the support arm 8, and is connected to an inclinable swash plate 9 mounted around the drive shaft 6 so as to be able to change an angle of inclination thereof with respect to a plane extending perpendicularly to the rotating axis of the drive shaft 6. The rotation of the drive shaft 6 is transmitted to the swash plate 9 via the rotor 7 and the connecting pin 8*b*.

A sleeve element 10 is arranged adjacent to the rearmost end of the rotor 7, and is axially slidably mounted on the drive shaft 6 while it is constantly urged toward the rotor 7 by a spring 11. The sleeve element 10 is provided with a pair of lateral trunnion pins 10*a* ( only one of them is shown in FIG. 1) on which the swash plate 9 is pivoted.

A wobble plate 12 is supported on a rear boss of the swash plate 9 via thrust and slide bearings attached to the rear boss of the swash plate 9. Thus, the wobble plate 12 can be free from rotation during the rotation of the swash plate 9. Usually, the wobble plate 12 is prevented from being rotated by an appropriate means such as an engagement of a cut formed in a peripheral portion of the wobble plate 12 and a fixed rod mounted in the compressor body.

The wobble plate 12 is pivotally connected, at the peripheral portion thereof, to respective ends of six equiangularly arranged connecting rods 14 which are pivotally connected to reciprocating-pistons 15, respectively. The reciprocating-pistons 15 are slidably fit in respective cylinder bores 1A through 1F. Thus, the rotation of the drive shaft 6 is converted by the rotor 7 and the swash plate 9 into a nutating motion of the wobble plate 12 about the drive shaft 4, which in turn causes reciprocating motion of respective pistons 15 in the related cylinder bores 1A through 1F. In response to the reciprocating motion of the pistons 15 in respective cylinder bores 1A through 1F, each of the latter cylinder bores 1A through 1F has three sequential operational phases, i.e., a suction phase to pump in the refrigerant gas, a compressing phase to compress the refrigerant gas, and a discharging phase to discharge the refrigerant gas.

In the described wobble-plate-operated reciprocating-piston type compressor, the stroke of reciprocation of respective pistons 15 within the cylinder bores 1A through 1F changes in response to a change in pressure differential between a gas pressure prevailing in the crank case 5 and a suction pressure of the refrigerant gas.-Depending on the change of the stroke of the pistons 15, the angle of inclination of the swash and wobble plates 9 and 12 is changed. The gas pressure level in the crank case 5 is adjustably controlled by a control valve (not shown in FIGS. 1 and 2) housed in the rear housing 4 on the basis of air-conditioning load applied to the air-conditioning system.

The rear housing 4 is provided with a central suction chamber 17 in the form of an axial through-bore having an aperture formed in the outer face of the rear housing. The suction chamber 17 is directly communicated with the central bore la of the cylinder block 1. The rear housing 4 is also provided with a discharge chamber 18 for receiving the compressed refrigerant gas when it is discharged from the respective cylinder bores 1A through 1F. The discharge chamber 18 is arranged around and isolated from the central suction chamber 17. The valve plate 3 is provided with six bore-like discharge ports 3*a* communicated with head portions of respective cylinder bores 1A through 1F. The respective discharge ports 3*a* are closed by flapper-type discharge valves 20 attached to the outer face of the valve plate 3 facing respective discharge chamber 18. The discharge valves 20 are backed up by retainers 21 capable of limiting the movement of the discharge valves 20.

As best shown in FIG. 2, the cylinder block 1 is provided with radial communication passageways 2A through 2F providing a constant fluid communication between the central bore 1*a* of the cylinder block 1 and respective cylinder bores 1A through 1F.

The radial communication passageways 2A through 2F have respective outward openings formed in the head portion of respective cylinder bores 1A through 1F and respective inward openings formed in the cylindrically extending inner wall of the central bore 1*a* of the cylinder block 1, respectively. The inward openings of the communication passageways 2A through 2F are equidistantly spaced from one another as shown in the developed illustration of the cylindrical inner wall of the central bore la in FIGS. 3 and 4.

Figure 3:
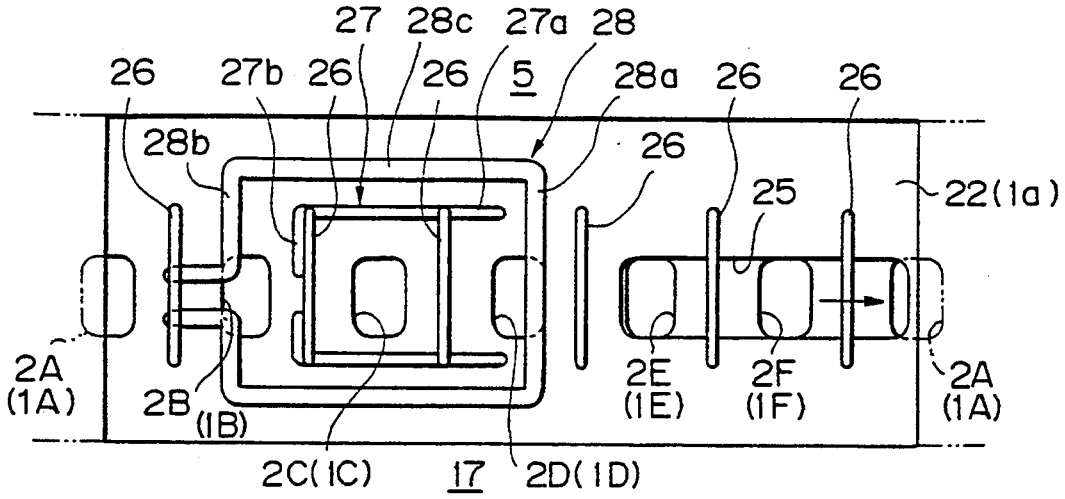
FIG. 3 is a developed view illustrating a specific positional relationship between the rotary-type valve element and the inner wall of the valve receiving chamber, with respect to the compressor of FIG. 1.
Figure 4:
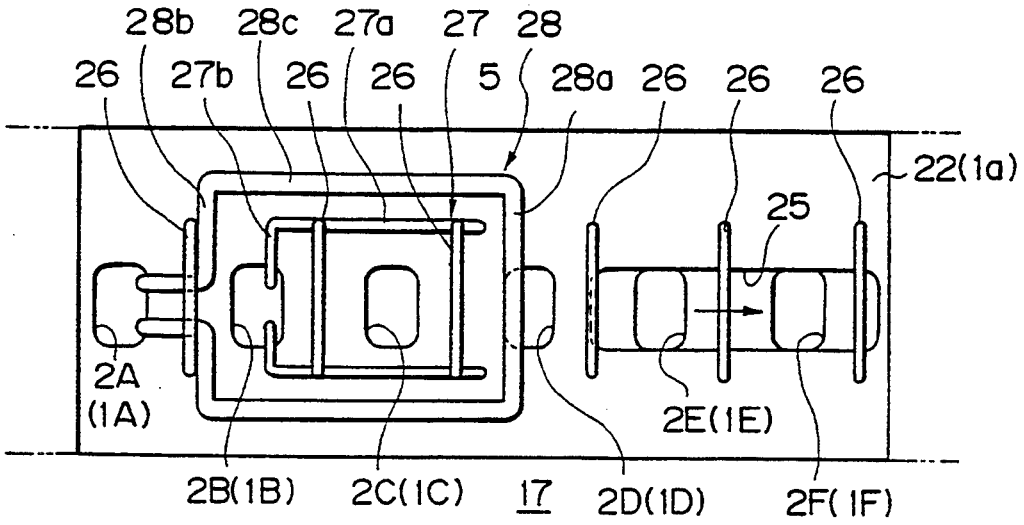
FIG. 4 is a similar developed view illustrating another specific positional relationship between the rotary-type valve element and the inner wall of the valve receiving chamber, with respect to the compressor of FIG. 1.

The cylindrical inner wall of the central bore 1a of the cylinder block 1 is further provided with first gas-receiving grooves 26 in the form of an axial straight channel formed therein. The first gas-receiving grooves 26 are equiangularly spaced apart from one another, and each groove 26 is disposed at approximately a middle position between the two neighboring openings of the above-mentioned communication passageways 2A through 2F as shown in FIGS. 3 and 4.

As shown in FIG. 1, a rotary-type suction valve element 22 in the form of a cylindrical member is received in the central bore 1*a* of the cylinder block 1. The suction valve element 22 is connected to the rearmost end of the drive shaft 6 so as to be rotated together with the drive shaft. The outer circumference of the rotary-type suction valve element 22 is in sliding contact with the cylindrical inner wall of the central bore 1*a*. An axial rear end of the suction valve element 22 is axially supported by an inner wall of the suction chamber 17 via a thrust bearing. The rotary-type suction valve element 22 is provided with a suction passageway 25 having a central passageway portion extending axially inwardly from the center of the rear end of the valve element 22 to an innermost end located at an approximately axial middle position of the valve element 22, and a radial passageway portion which opens in the outer circumference of the valve element 22. The opening of the radial passageway portion of the suction passageway 25 is extended in the circumferential direction over a predetermined angle as will be understood from the illustration of FIGS. 3 and 4. The opening of the suction passageway 25 of the suction valve element 22 is arranged so as to successively communicate with the openings of the communication passageways 2A through 2F of the cylinder block 1 when the suction valve element 22 rotates together with the drive shaft 6.

The rotary-type suction valve element 22 is further provided with a second gas-routing groove 27. The second gas-routing groove 27 of the suction valve element 22 is formed in the outer circumference thereof at a specified area constantly facing respective cylinder bores 1A through 1F in the compressing and discharging phases during rotation of the suction valve element 22. The second gas-routing groove 27 includes a pair of circumferentially extending main grooves 27*a* capable of successively coming into communication with the respective first gas-receiving grooves 26 of the cylindrical inner wall of the central bore la in response to rotation of the suction valve element 22, and a pair of axial branch grooves 27*b* extending from leading ends of the main grooves 27*a* toward ends capable of successively coming into communication with the respective openings of the communication passageways 2A through 2B in response to rotation of the suction valve element 22. It should be noted that the arrangement of the above-mentioned axial branch grooves 27*b* in the outer circumference of the suction valve element 22 is so designed that the branch grooves 27*b* communicate with via the communication passageways 2A through 2F, the cylinder bores 1A through 1F at a substantially initial stage of the compressing phase, and do not communicate with the cylinder bores 1A through 1F at a stage immediately after the suction phase.

The rotary-type suction valve element 22 is still further provided with a residual-gas routing groove 28 formed in the outer circumference thereof. As shown in FIGS. 3 and 4, the residual gas routing groove 28 is arranged so as to surround the above-mentioned second gas-routing groove 27.

The above-mentioned residual gas routing groove 28 includes an axially extending groove 28*a* capable of successively coming into communication with the respective cylinder bores 1A through 1F at the ending stage of the discharging phase, via respective communication passageways 2A through 2F, in response to rotation of the suction valve element 22. The groove 28 also includes a pair of rectangular grooves 28*b* capable of coming into communication with the respective cylinder bores 1A through 1F under a lower pressure via the respective communication passageways 2A through 2F, in response to rotation of the suction valve element 22. The rectangular grooves 28*b* are connected to the axially extending groove 28*a* by a pair of communication grooves 28*c* extending circumferentially. The groove 28*a* receives the residual refrigerant gas under pressure from the respective cylinder bores 1A through 1F when the cylinder bores 1A through 1F are at the ending stage of the discharging phase, and the residual refrigerant gas received by the groove 28*a* is routed to the respective cylinder bores 1A through 1F in which a low gas pressure prevails through the communication grooves 28*c* and the rectangular grooves 28*b*. Therefore, the rectangular grooves 28*b* are preferably provided with a pair of axial groove portions capable of coming into communication with the cylinder bores 1A through 1F at a substantially initial stage of the compressing phase in response to rotation of the suction valve element 22, and a pair of circumferential groove portions capable of coming into communication with the cylinder bores 1A through 1F at the initial stage of the suction stage in response to rotation of the suction valve element 22 at a time when the above-mentioned axial groove portions come out of communication with the cylinder bores 1A through 1F at a substantially initial stage of the compressing phase.

The description of the operation of the compressor according to the first embodiment will be provided hereinbelow.

When the drive shaft 6 of the compressor is rotated by the external drive force, the swash plate 9 is rotated together with the drive shaft 6 while performing a nutating motion thereof. The non-rotatable wobble plate 12 supported by the swash plate 9 carries out a nutating motion thereof to cause the reciprocation of the respective pistons 15 in the cylinder bores 1A through 1F. When the pistons 15 are moved from the top dead center thereof toward the bottom dead center thereof in the cylinder bores 1A through 1F, the latter cylinder bores 1A through 1F come into the suction phase. When the pistons 15 are moved from the bottom dead center thereof toward the top dead center thereof in the cylinder bores 1A through 1F, the latter cylinder bores 1A through 1F come into the compressing and discharging phases.

The rotary-type suction valve element 22 is rotated together with the drive shaft 6 in a predetermined direction as shown by an arrow in FIG. 2.

When the suction valve element 22 is rotated so as to take a position shown in FIG. 3 (FIGS. 3 and 4 are developed views of the rotary-type suction valve element 22 and the cylindrical inner wall of the central bore 1*a* of the cylinder block 1, respectively, and each arrow shown in these developed views indicates a direction in which the openings of the communication passageways 2A through 2F are relatively moved in response to the rotation of the rotary-type suction valve element 22.), the cylinder bores 1E, 1F and 1A in the suction phase communicate with the suction passageway 25 of the suction valve element 22 via the communication passageways 2E, 2F, and 2A. Thus, the refrigerant gas before compression is supplied from the suction chamber 17 of the rear housing 4 into the cylinder bores 1E, 1F and 1A via the suction passageway 25 of the suction valve element 22 and the communication passageways 2E, 2F and 2A.

On the other hand, the cylinder bores 1B and 1C in the compressing phase and the related communication passageways 2B and 2C are closed by the outer circumference of the suction valve element 22. At this stage, a gas pressure prevailing in the interior of the cylinder bores 1B and 1C is lower than that in the discharge chamber 18 of the rear housing 4, and accordingly, the discharge valves 20 of these cylinder bores 1B and 1C close the related discharge ports 3a.

The cylinder bore 1D in the discharge phase is disconnected from the suction passageway 25 of the suction valve element 22 as shown in FIG. 3. Namely, the opening of the communication passageway 2D of the cylinder bore 1D is closed by the outer circumference of the suction valve element 22. At this stage, a gas pressure prevailing in the cylinder bore 1D is increased to a level higher than that in the discharge chamber 18. Accordingly, the discharge valve 20 of the cylinder bore 1D is moved to the opening position thereof opening the discharge port 3a of the cylinder bore 1D.

When the rotary-type suction valve element 22 is rotated together with the drive shaft 6 while maintaining a predetermined timed relationship with the reciprocating movement of the respective pistons 15, each of the respective cylinder bores 1A through 1F repeats, in order, the suction phase, the compressing phase, and the discharging phase. When each of the respective cylinder bores 1A through 1F comes into the suction phase, it communicates with the suction chamber 17 through each of the respective communication passageways 2A through 2F, and the suction passageway 25 of the suction valve element 22, so that the refrigerant gas is smoothly and stably pumped in from the suction chamber 17.

When the rotary-type suction valve element 22 is rotated to the position shown in FIG. 3, the communication passageway 2D of the cylinder bore 1D undertaking the ending stage of the discharge phase communicates with the axially extending groove 28a of the residual gas routing groove 28, and accordingly, the residual gas remaining in the cylinder bore 1C enters the groove 28a, and is routed toward the grooves 28b via the grooves 28c, and enters the cylinder bore 1B in the compression phase via the communication passageway 2B.

When the rotary-type suction valve 22 is further rotated to a position shown in FIG. 4, the residual gas in the residual gas routing groove 28 is routed into the cylinder bore 1A which is at a stage immediately after the completion of the suction phase. Therefore, the residual gas in the cylinder bore 1D can be thoroughly removed by the residual-gas routing groove 28.

When the rotary-type suction valve 22 is further rotated from the position of FIG. 4, the cylinder bore 1D from which the residual gas is removed comes into the suction phase. Therefore, no expansion of the residual gas occurs in the cylinder bore 1C, and the suction of an adequate amount of the refrigerant gas from the suction chamber 17 is smoothly carried out. The same adequate suction of the refrigerant gas is similarly carried out by each of the respective cylinder bores 1A through 1F during rotation of the rotary-type suction valve element 22. Therefore, an adequate volumetric compression efficiency can be exhibited by the reciprocating-piston type compressor of the above-described embodiment.

Moreover, when the rotary-type suction valve element 22 is rotated to the position shown in FIG. 3, a part of the contacting area of the cylindrical inner wall of the central bore 1a and the outer circumference of the rotary-type suction valve element 22, i.e., an area facing the cylinder bores 1C and 1D undertaking the compressing and discharging phases, via the respective communication passageways 2C and 2D, is subjected to a high pressure of the compressed refrigerant gas. Accordingly, there may occur a leakage of the refrigerant gas under high pressure from these cylinder bores into the above-mentioned part of the contacting area. Nevertheless, the leaking refrigerant gas under high pressure does not reach the crank chamber 5, the suction chamber 17, and the suction passageway 25 due to provision of the first gas-receiving grooves 26 and the second gas-routing groove 27. Namely, the leaking gas flowing in the circumferential direction of the suction valve element 22 is captured by the grooves 28a of the residual gas routing groove 28 and by the first gas-receiving grooves 26 of the inner wall of the central bore 1a, and the leaking gas flowing in the axial direction of the suction valve element 22 is captured by the main grooves 27a of the second gas-routing groove 27.

The gas captured by the first gas-receiving grooves 26 is carried into the main grooves 27a of the second gas-routing groove 27 in response to rotation of the suction valve element 22, and is subsequently carried toward the pair of axial branch grooves 27b of the second gas-routing groove 27. Thus, when the rotary-type suction valve element 22 is rotated to the position shown in FIG. 4, the gas in the second gas-routing groove 27 is drawn into the cylinder bore 1B undertaking the initial stage of the compressing phase via the pair of axial branch grooves 27b, and is then compressed in the cylinder bore 1B. At this stage, a gas pressure level in the cylinder bore 1B becomes higher than that in the cylinder bore 1A undertaking a stage immediately after the suction phase and before the commencement of the compressing phase.

The gas captured by the axial groove 28a of the residual gas routing groove 28 is routed toward the pair of crank grooves 28b via the communication grooves 28c. Therefore, the gas is drawn into the cylinder bore 1B (FIG. 3) undertaking the initial stage of the compressing phase so as to be compressed therein, and then into the cylinder bore 1A (FIG. 4) undertaking a stage immediately after the suction phase so as to be compressed therein. Thus, the leaking refrigerant gas under high pressure in the above-mentioned contacting area can be returned to the cylinder bores in the compressing phase without permitting it to enter the low pressure region of the compressor such as the suction chamber 17, and the suction passageway 25 of the suction valve element 22. Accordingly, the volumetric compression efficiency of the compressor can be increased with the aforementioned conventional compressor of JP-A-5-71467. The drive force-to-work efficiency of the compressor can be also increased. Further, a raise of the temperature of the refrigerant gas delivered by the compressor can be suppressed.

Figure 5:
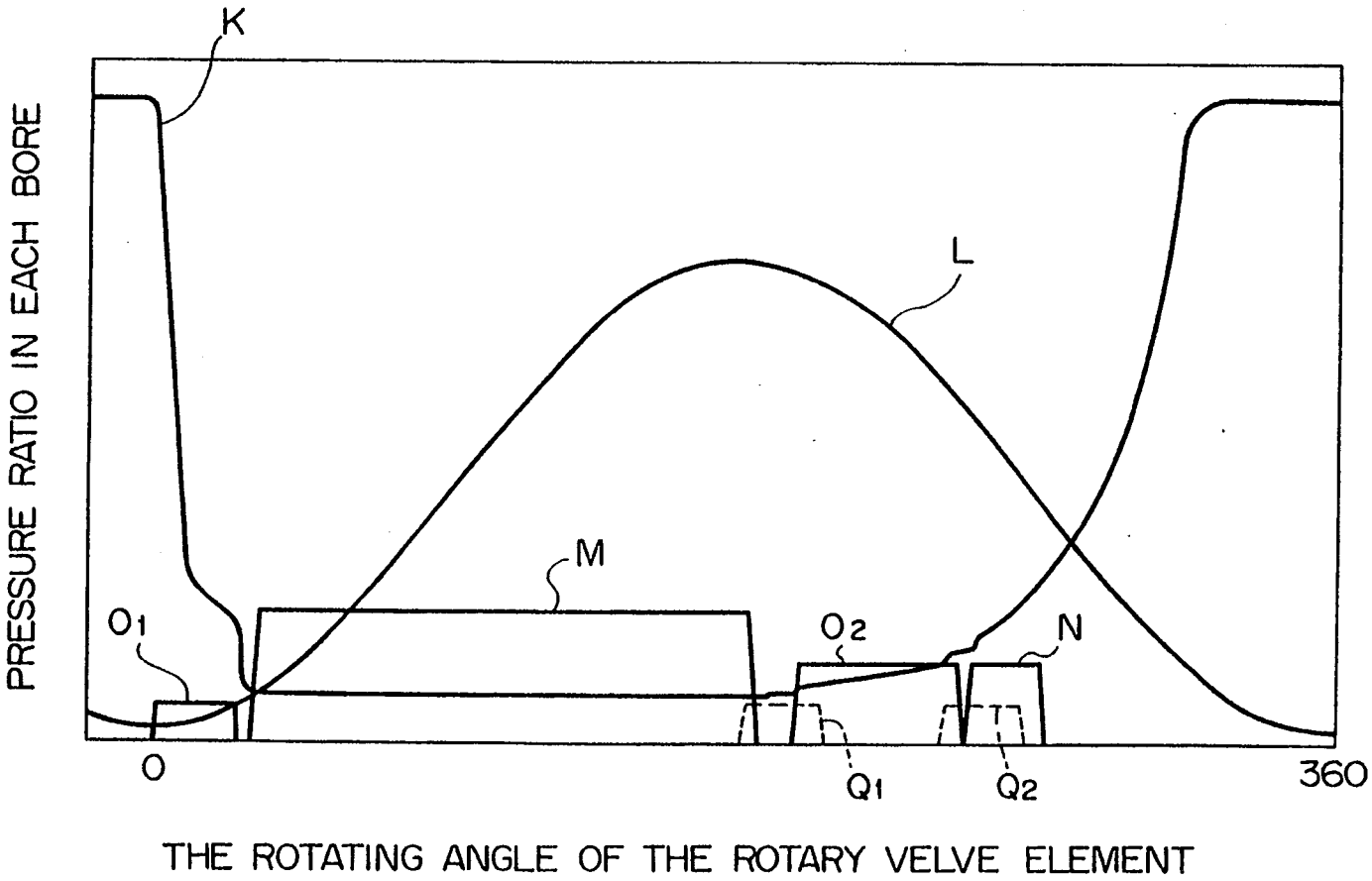
FIG. 5 is a graphical view indicating various characteristic curves with regard to one of a plurality of cylinder bores of the compressor of FIG. 1.

FIG. 5 indicates characteristic curves of the compressor of FIGS. 1 and 2, in which the curve "K" indicates a relationship between the rotating angle of the rotary-type suction valve element 22 (abscissa) and a pressure ratio (ordinate) with respect to a specified cylinder bore, e.g., the cylinder bore 1D in the state shown in FIGS. 3 and 4. A curve "L" indicates a change in the volume of the cylinder bore 1D, a curve "M" indicates an angular interval in which the suction passageway 25 of the suction valve element 22 communicates with the communication passageway 2D of the cylinder bore 1D, and a curve "N" indicates an angular interval in which the pair of axial branch grooves 27b of the second gas-routing groove 27 communicate with the communication passageway 2D of the cylinder bore 1D. A curve "$O_1$" indicates an angular interval in which the axial groove 28*a* of the residual gas routing groove 28 communicates with the communication passageway 2D of the cylinder bore 1D, and a curve "$O_2$" indicates an angular interval in which the rectangular grooves 28*b* of the residual gas routing groove 28 communicate with the communication passageway 2D of the cylinder bore 1D.

A curve "$Q_1$" indicates an angular interval in which the axial groove 28*a* of the residual gas routing groove 28 communicates with the communication passageway 2A of the cylinder bore 1A, and a curve "$Q_2$" indicates an angular interval in which the axial groove 28*a* of the residual gas routing groove 28 communicates with the communication passageway 2F of the cylinder bore 1F.

From the characteristic curves of FIG. 5, it is understood that when the piston 15 received in the cylinder bore 1D is moved past the top dead center thereof, the axial groove 28*a* of the residual gas routing groove 28 communicates with the communication passageway 2D of the cylinder bore 1D over the angular interval "$O_1$". At the initial half of the interval "$O_1$", the residual gas coming from the cylinder bore 1D is captured by the residual gas routing groove 28, and is routed into the cylinder bore 1B. At the remaining half of the interval "$O_1$", the residual gas captured by the residual gas routing groove 28 is routed into the cylinder bore 1A.

During the angular interval "$O_2$" of the rotation of the suction valve element 22, the rectangular grooves 28*b* of the residual gas routing groove 28 communicates with the communication passageway 2D of the cylinder bore 1D. Further, during the angular interval "$Q_1$" of the rotation of the suction valve element 22, the axial groove 28*a* of the residual gas routing groove 28 communicates with the communication passageway 2A. Thus, while the former interval "$O_2$" is being superimposed with the latter interval "$Q_1$", the residual gas is captured from the cylinder bore 1A by the residual gas routing groove 28, and is routed into the cylinder bore 1D.

Further, during the interval "$Q_2$" the axial groove 28*a* of the residual gas routing groove 28 communicates with the communication passageway 2F of the cylinder bore 1F. Thus, while the interval "$Q_2$" is being superimposed with the latter interval "$O_2$", the residual gas is captured from the cylinder bore 1F by the residual gas routing groove 28, and is routed into the cylinder bore 1D.

From the detailed observation of the curve "K", it is understood that an adequate increase in the pressure ratio occurs at the commencement of the superimposing of the intervals "$Q_1$" and "$O_2$", and at the commencement of the superimposing of the intervals "$Q_2$" and "$O_2$".

The pair of axial branch grooves 27*b* of the second gas-routing groove 27 communicate with the communication passageway 2D of the cylinder bore 1D during the angular interval "N". Thus, the gas under high pressure leaking into the contacting area of the cylindrical inner wall of the central bore 1*a* and the outer circumference of the suction valve element 22 can be captured by the second gas-routing groove 27 and is routed into the cylinder bore 1D. Thus, at the commencement of the angular interval "N", the pressure ratio in the cylinder bore 1D is adequately increased as shown in the curve "K".

Figure 6:
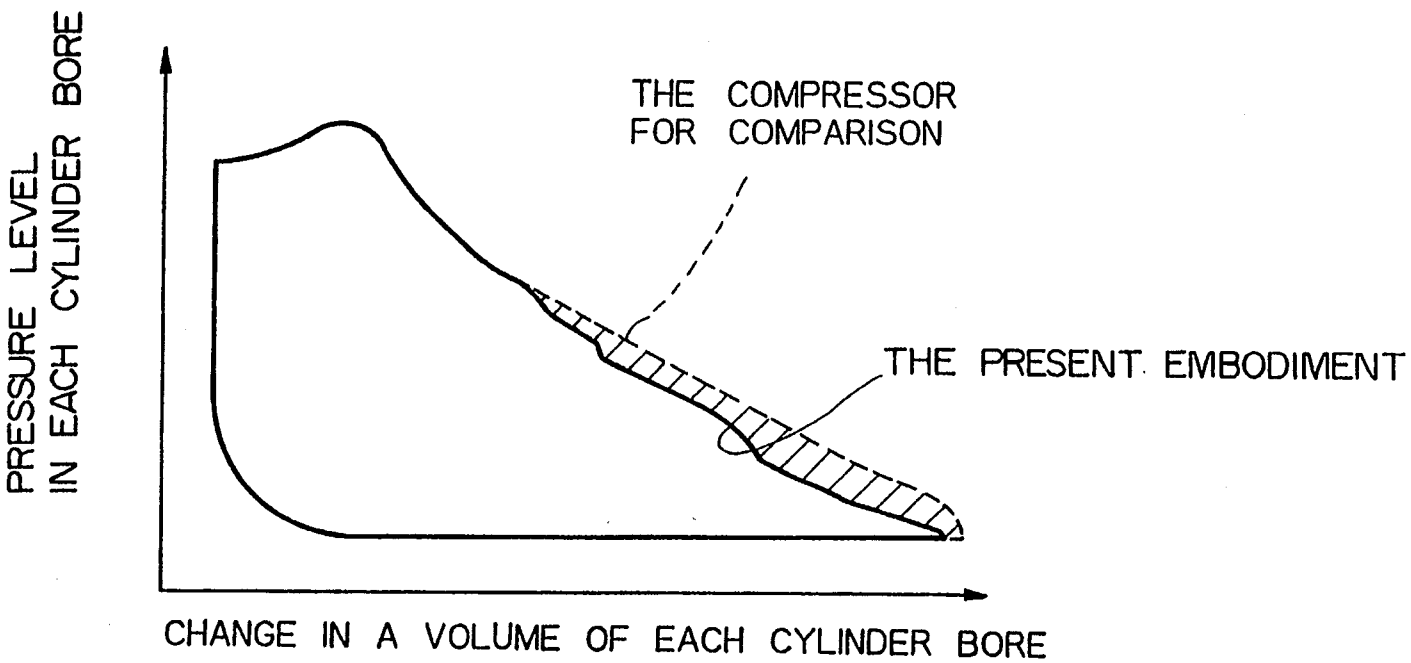
FIG. 6 is a graphical view indicating a relationship between a change in the volume of each cylinder bore and a change in pressure level prevailing in the cylinder bore, with regard to the compressor of FIG. 1.

FIG. 6 indicates a relationship between a change in the volume of each cylinder bore and a pressure level in each cylinder bore, with respect to the compressor according to the embodiment of FIGS. 1 and 2 and a separate compressor assembled for comparison purposes. In the latter compressor assembled for comparison, the branch grooves 27*b* of the second gas-routing groove 27 and the rectangular grooves 28*b* of the residual gas routing groove 28 of the rotary-type suction valve element 22 is designed such that both of them commonly communicate with respective cylinder bores 1A through 1F undertaking a stage immediately after the completion of the suction phase. The design of the other construction of the compressor assembled for comparison is the same as the compressor of the first embodiment of the present invention.

From the illustration of FIG. 6, it is understood that in the compressor of the first embodiment of the present invention, the pressure level in each cylinder bore at the initial stage of the compressing phase is lower than that of the compressor for comparison, and that the drive force-to-work efficiency of the compressor of the first embodiment is increased compared with that of the compressor for comparison. Namely, the compressor of the first embodiment of the present invention is able to exhibit a higher volumetric compression efficiency, and a higher drive force-to-work efficiency compared with the compressor for comparison. Further, the compressor of the first embodiment is able to suppress a rise in the temperature of the compressed refrigerant gas delivered from the compressor.

Figure 7:
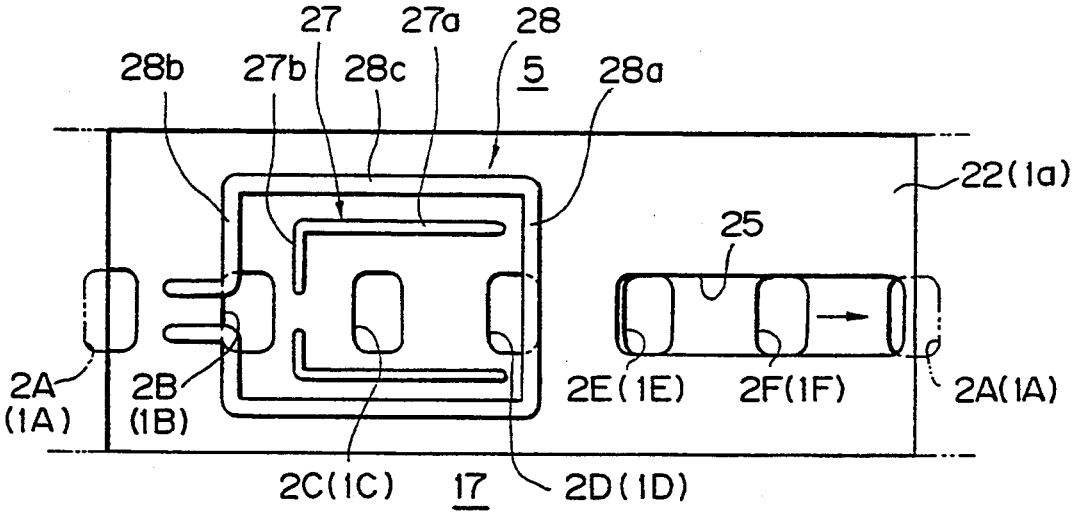
FIG. 7 is a developed view illustrating a specific positional relationship between the rotary-type valve element and the inner wall of the valve receiving chamber, with respect to the compressor according to a second embodiment of the present invention.
Figure 8:
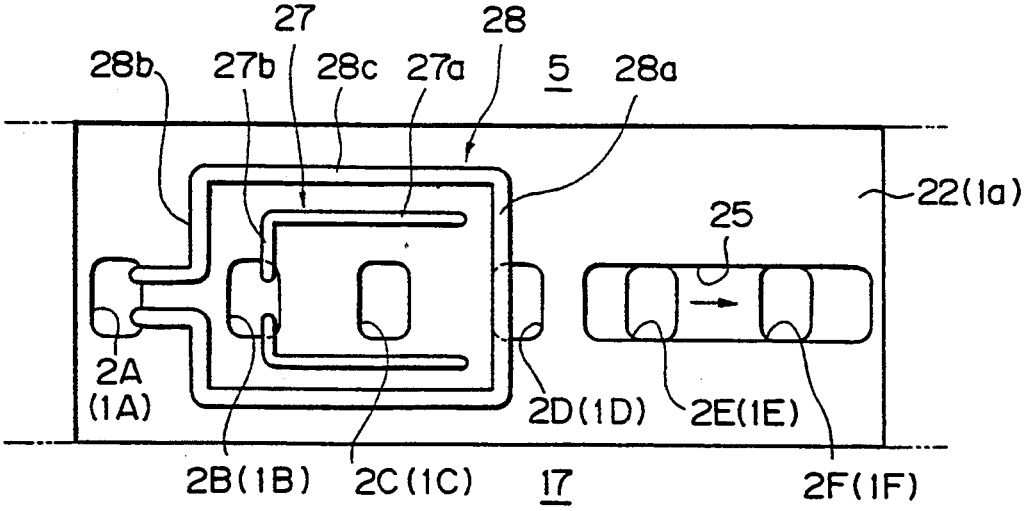
FIG. 8 is a similar developed view illustrating another specific positional relationship between the rotary-type valve element and the inner wall of the valve receiving chamber, with respect to the compressor according to the second embodiment.

Referring to FIGS. 7 and 8 illustrating the compressor according to the second embodiment of the present invention, the rotary-type suction valve element 22 is provided with a gas routing-groove 27 which is similar to the second gas-routing groove 27 of the first embodiment. Namely, the gas routing-groove 27 includes a pair of circumferential grooves 27*a* receiving the leaking gas under high pressure, and a pair of branch grooves 27*b* routing the leaking gas received by the circumferential grooves 27*a* toward respective cylinder bores undertaking the compressing phase. Nevertheless, the compressor of the second embodiment is not provided with gas receiving grooves corresponding to the first gas receiving grooves 26 of the compressor of the first embodiment.

The other construction of the compressor of the second embodiment is the same as that of the first embodiment.

Although the rotary-type suction valve mechanism of the second embodiment of the present invention is unable to capture the leaking gas under high pressure flowing in the circumferential direction of the rotary-type suction valve element 22, the other operation and performance of the suction valve mechanism is the same as the rotary-type suction valve mechanism of the aforementioned first embodiment of the present invention.

From the foregoing description of the present invention, it .will be understood that in accordance with the present invention, the volumetric compression efficiency as well as the drive force-to-work efficiency of the reciprocating-type refrigerant compressor can be adequately enhanced. Further, the rise in the temperature of the compressed refrigerant gas delivered by the reciprocating-type refrigerant compressor can be suppressed.

It should be understood that various modifications and variations will occur to a person skilled in the art without departing the scope and spirit of the invention as claimed in the accompanying claims.

We claim:

1. A reciprocating-piston-type refrigerant compressor provided with a body including a cylinder block having a central bore extending axially about a central axis, a plurality of axial cylinder bores formed in the cylinder block of the body and arranged around the central axis of the cylinder block, a crank or swash plate chamber formed in the body as an independent chamber separate from the cylinder bores of the cylinder block, an axial drive shaft extending through the crank chamber and rotatably supported in the body, the axial drive shaft having one end disposed in the central bore of the cylinder block, at least one suction-gas-receiving chamber formed in the body for receiving refrigerant gas before compression, and a plurality of reciprocating pistons axially slidably received in the plurality of cylinder bores and reciprocated by a piston drive mechanism arranged in the crank chamber so as to be driven by the drive shaft, comprising:

a rotary valve means connected to the one end of the drive shaft so as to rotate together with said drive shaft, the rotary valve means having a generally cylindrical outer circumference thereof, and a suction passageway for permitting the refrigerant gas before compression to be pumped from the suction-gas-receiving chamber into respective ones of said cylinder bores in a timed relationship with the reciprocation of said reciprocating pistons during rotation of said rotary valve means;

means for defining a recessed chamber in the central bore of the cylinder block for rotatably receiving said rotary valve means, the recessed chamber being surrounded by an inner wall area being in sealing contact with the cylindrical outer circumference of the rotary valve means;

a first means for receiving a part of the compressed refrigerant gas leaking from the respective cylinder bores in the phase of compressing and discharging operation into a contacting area between the inner wall area of the recessed chamber and the outer circumference of the rotary valve means; said first means being comprised of a plurality of axial grooves formed in said inner wall area of said recessed chamber, each of said plurality of axial grooves being arranged between two neighboring communication passageways of said plurality of communication passageways of said cylinder block and able to define a closed cavity in cooperation with said outer circumference of said rotary valve means, for receiving the compressed gas, and a second means for routing the part of the compressed refrigerant gas received by the first means into the respective cylinder bores in the phase of an initial stage of a compressing operation immediately after the suction phase.

2. A reciprocating-piston-type refrigerant compressor according to claim 1, wherein said cylinder block of said body is provided with a plurality of communication passageways communicating between said central bore of said cylinder block and said plurality of cylinder bores, respectively, said plurality of communication passageways being arranged so as to fluidly communicate with said suction passageway of said rotary valve means in a timed relationship with the reciprocation of said reciprocating pistons during rotation of said rotary valve means to thereby permit the refrigerant gas before compression to be pumped into said respective cylinder bores.

3. A reciprocating-piston-type refrigerant compressor according to claim 2, wherein each of said plurality of axial grooves being arranged between two neighboring communication passageways of said plurality of communication passageways of Said cylinder block and able to define a closed cavity in cooperation with said outer circumference of said rotary valve means, for receiving the compressed gas, and wherein said second means for routing the part of the compressed refrigerant gas comprises:

at least one circumferentially groomed passageway formed in said outer circumference of said rotary valve means in such a manner that, during the rotation of said rotary valve means, said circumferentially grooved passageway of said second means successively comes in fluid communication with each of said plurality of axial grooves of said first means to thereby receive the compressed gas from each said axial groove of said first means; and at least one branch passageway formed in said outer circumference of said rotary valve means so as to route the compressed gas received by said circumferentially grooved passageway toward one of said plurality of cylinder bores in the phase of an initial stage of a compressing operation immediately after the suction phase.

4. A reciprocating-piston-type refrigerant compressor according to claim 3, wherein said second means for routing the part of the compressed refrigerant gas comprises:

a pair of circumferentially grooved passageways formed in said outer circumference of said rotary valve means, said pair of circumferentially grooved passageways extending in such a manner that, during the rotation of said rotary valve means, said circumferentially grooved passageways of said second means successively come in fluid communication with axial ends of each of said plurality of axial grooves of said first means to thereby receive the compressed gas from each said axial groove of said first means; and a pair of branch passageways formed in said outer circumference of said rotary valve means so as to route the compressed refrigerant gas received by said pair of circumferentially grooved passageways toward one of said plurality of cylinder bores which is in the phase of an initial stage of a compressing operation immediately after the suction phase.

5. A reciprocating-piston-type refrigerant compressor according to claim 3, wherein said cylinder block is provided with six axially extending cylinder bores and six gas passageways communicating between said central bore of said cylinder block and said six cylinder bores, respectively, wherein said first means for receiving a part of the compressed refrigerant gas comprises six axial grooves formed in said inner wall area of said recessed chamber, each of said six axial grooves being arranged between two neighboring gas passageways of said six gas passageways of said cylinder block, and wherein said second means for routing the part of the compressed refrigerant gas comprises:

at least one circumferentially grooved passageway formed in said outer circumference of said rotary valve means in such a manner that, during the rotation of said rotary valve means, said circumferentially grooved passageway of said second means successively comes in fluid communication with each of said six axial grooves of said first means to thereby receive the compressed gas from each said axial groove of said first means; and at least one branch passageway formed in said outer circumference Of said rotary valve means so as to route the compressed gas received by said circumferentially grooved passageway toward one of said plurality of cylinder bores in the phase of an initial stage of compressing operation immediately after the suction phase.

6. A reciprocating-piston-type refrigerant compressor according to claim 2, wherein said first means for receiving a part of the compressed refrigerant gas comprises a first grooved passageway means formed in said cylindrical outer circumference of said rotary valve means, said first grooved passageway means including at least one circumferentially extending groove receiving the part of the compressed refrigerant gas leaking from said respective cylinder bores in the phase of compressing and discharging operation into the contacting area during rotation of said rotary valve means, and wherein said second means for routing the part of the compressed refrigerant gas comprises:

a second grooved passageway means formed in said outer circumference of said rotary valve means, said second grooved passageway means including at least one axially extending groove connected to said circumferentially extending groove of said first grooved passageway means and routing said part of the compressed refrigerant gas received by said circumferentially extending groove toward said respective cylinder bores in the phase of a substantially initial stage of compressing operation.

7. A reciprocating-piston-type refrigerant compressor according to claim 6, wherein said first grooved passageway means of said first means comprises a pair of circumferentially extending grooves receiving the part of the compressed refrigerant gas leaking from said respective cylinder bores in the phase of compressing and discharging operation into the contacting area during rotation of said rotary valve means, and wherein said second grooved passageway means of said second means comprises a pair of axially extending grooves connected to said pair of circumferentially extending grooves of said first grooved passageway means and routing said part of the compressed refrigerant gas received by said circumferentially extending grooves toward said respective cylinder bores in the phase of a substantially initial stage of compressing operation.

8. A reciprocating-piston-type refrigerant compressor according to claim 6, further comprises:

a third grooved passageway means formed in said outer circumference of said rotary valve means for receiving a part of the compressed refrigerant gas remaining in said respective cylinder bores in the phase of an initial stage of the suction phase immediately after the discharge phase; and a fourth grooved passageway means formed in said outer circumference of said rotary valve means for routing the part of the compressed refrigerant gas received by said third grooved passageway means toward said cylinder bore in the phase of an initial stage of the compressing phase immediately after the suction phase.

9. A reciprocating-piston-type refrigerant compressor according to claim 3, further comprising:

a third grooved passageway means formed in said outer circumference of said rotary valve means for receiving a part of the compressed refrigerant gas remaining in said respective cylinder bores in the phase of an initial stage of the suction phase immediately after the discharge phase; and a fourth grooved passageway means formed in said outer circumference of said rotary valve means, for routing the part of the compressed refrigerant gas received by said third grooved passageway means toward said cylinder bore in the phase of an initial stage of the compressing phase immediately after the suction phase.

* * * * *